US005163400A

United States Patent [19]

Yoshioka et al.

[11] Patent Number: 5,163,400

[45] Date of Patent: Nov. 17, 1992

[54] ENGINE UNIT

[75] Inventors: Tooru Yoshioka; Hideyuki Hashiba, both of Gunma, Japan

[73] Assignee: Sawafuji Electric Co. Ltd., Tokyo, Japan

[21] Appl. No.: 638,698

[22] Filed: Jan. 8, 1991

[30] Foreign Application Priority Data

Jan. 16, 1990 [JP] Japan ..... 2-6954
Jul. 18, 1990 [JP] Japan ..... 2-190074
Jul. 30, 1990 [JP] Japan ..... 2-202297

[51] Int. Cl.[5] ..... F02D 41/00

[52] U.S. Cl. ..... 123/361; 290/40 R

[58] Field of Search ..... 123/361, 376, 399, 349, 123/352, 363, 400, 403, 192 R, 197, 342; 290/40 R, 40 A

[56] References Cited

U.S. PATENT DOCUMENTS 4,601,271 7/1986 Ejiri et al. ..... 123/361
4,660,521 4/1987 Higuchi et al. ..... 123/376
4,721,176 1/1988 Kabasin et al. ..... 180/197
4,756,287 7/1988 Sakakibara et al. ..... 123/342
4,831,985 5/1989 Mabee et al. ..... 123/361
4,834,045 5/1989 Imai et al. ..... 123/352
4,915,074 4/1990 Arai ..... 123/399
4,919,096 4/1990 Manaka et al. ..... 123/361
4,938,190 7/1990 McCabe ..... 123/361
4,947,815 8/1990 Peter ..... 123/399
4,972,817 11/1990 Wilde et al. ..... 123/361
5,018,496 5/1991 Buchi ..... 123/399
5,020,491 6/1991 Mashino ..... 123/192 R

*Primary Examiner*—Raymond A. Nelli
*Attorney, Agent, or Firm*—McGlew and Tuttle

[57] ABSTRACT

An engine unit having a throttle valve drive unit constructed so as to cause a throttle valve to rotate and stop at a desired angular position, characterized in that the throttle valve drive unit comprises a synchronous motor for driving the throttle valve, a damping means for damping the rotation of the throttle valve, a voltage supply means for supplying d-c voltage to the synchronous motor, and a supply voltage control means for controlling the d-c voltage outputted by the voltage supply means;

the throttle valve being adapted to stop at an angular position at which the rotational torque generated by the synchronous motor in accordance with the supply voltage of the supply voltage controlling means and the damping torque of the damping means are balanced.

13 Claims, 6 Drawing Sheets

ENGINE UNIT

BACKGROUND OF THE INVENTION

This invention relates generally to an engine unit, and more particularly to an engine unit having an internal combustion engine, a drive unit for opening and closing an engine throttle valve, a drive power source for driving the drive unit, and a control unit for controlling the opening and closing of the throttle valve.

DESCRIPTION OF THE PRIOR ART

The engine unit incorporating an internal combustion engine is widely being used for power chemical sprayers, power mowers, etc. in agriculture, forestry and animal husbandry.

In order to keep at a constant level, or increase or decrease the number of revolution of the engine in accordance with the magnitude of load in such an engine unit, it is essential to control the opening and closing of a throttle valve. That is, the revolution of the engine is usually controlled by increasing or decreasing the amount of supply of vaporized fuel (gasoline) supplied to the internal combustion engine by opening and closing the throttle valve.

As a drive unit for opening and closing the throttle valve, a solenoid or d-c motor is commonly used.

When a solenoid is used as a drive unit of the throttle valve, however, a linkage mechanism is needed to covert the linear motion of the solenoid into the rotational motion of the throttle valve. This poses an unwanted problem of the complex construction of the drive unit.

When a d-c motor is used as a drive unit of the throttle valve, the presence of a commutator and brushgear in the d-c motor could lead to deteriorated durability.

SUMMARY OF THE INVENTION

This invention is intended to solve the aforementioned problems.

It is an object of this invention to provide an engine unit having a throttle valve drive unit having a simple construction and improved durability.

To this end, the engine unit of this invention has a throttle valve drive unit constructed so as to cause the throttle valve to rotate and stop at a desired angular position, and comprising a synchronous motor for driving the throttle valve, a control means for controlling the rotation of the throttle valve, a voltage supply means for supplying d-c voltage to the synchronous motor, and a supply voltage control means for controlling the d-c voltage outputted by the voltage supply means; the throttle valve being adapted to stop the throttle valve at an angular position at which the rotational torque generated by the synchronous motor in accordance with the supply voltage of the supply voltage control means and the damping torque of the damping means are balanced.

These and other objects and advantages of this invention will become apparent from the follwing description taken in conjunction with the accompanying drawings.

DETAILED DESCRIPTION OF PREFERRED EMBODIMENTS

Figure 1:
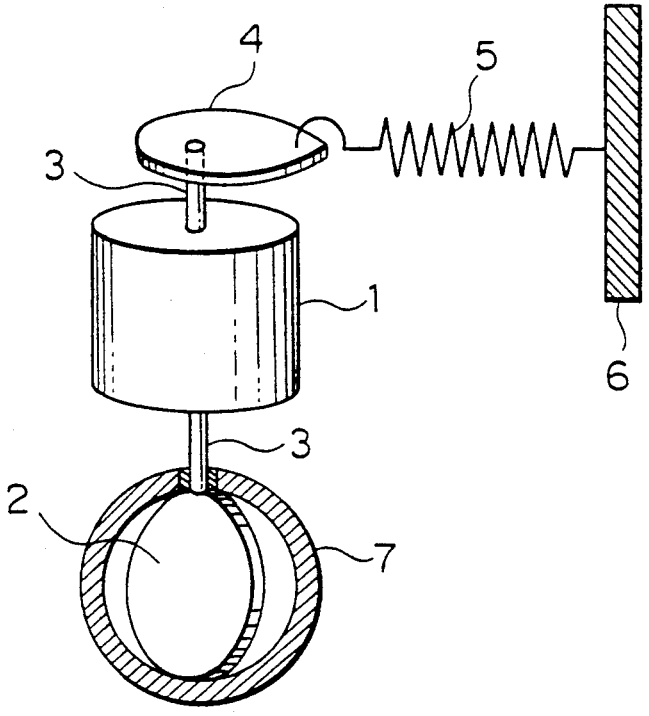
FIG. 1 is a diagram of assistance in explaning an embodiment of this invention.

FIG. 1 shows the construction of the essential part of an internal combusition engine in which an engine unit according to this invention is used.

In FIG. 1, a throttle valve 2 provided on a gas feed pipe 7 is used for regulating the flow of fuel gas fed to the engine from a carburetor (not shown) that vaporizes gasoline, for example. That is, the flow of the fuel gas is determined by appropriately controlling the rotational angle of the throttle valve 2 within an approximately 90-degree range from the perpendicular direction (fully-closed position) to the parallel position (full-opened position) with respect to the fuel-gas-feeding direction (the longitudinal direction of the gas feed pipe 7). The gas feed pipe 7 extends in the direction vertical to the paper, and only the cross-section thereof is shown with the other parts omitted. The same applies to the damper spring support, which will be described later.

A single-phase synchronous motor 1 is used as the drive actuator of the throttle shaft (directly connected to the motor shaft of the single-phase synchronous motor 1 in the embodiment shown in FIG. 1) of the throttle valve 2. A damper spring 5 for imparting damping torque to the throttle shaft 3 is installed to a damper spring support 6 via a damper plate 4 fixed to the throttle shaft 3. As d-c voltage is fed to the single-phase synchronous motor 1, rotational torque in accordance with the supply voltage is generated, as will be described later, the throttle shaft 3 is stopped at an angular position in which the rotational torque and the damping torque generated by the damper spring 5 are balanced. The rotational angle of the throttle valve 2 can be set in accordance with the value of the d-c voltage supplied to the single-phase synchronous motor 1.

Figure 2:
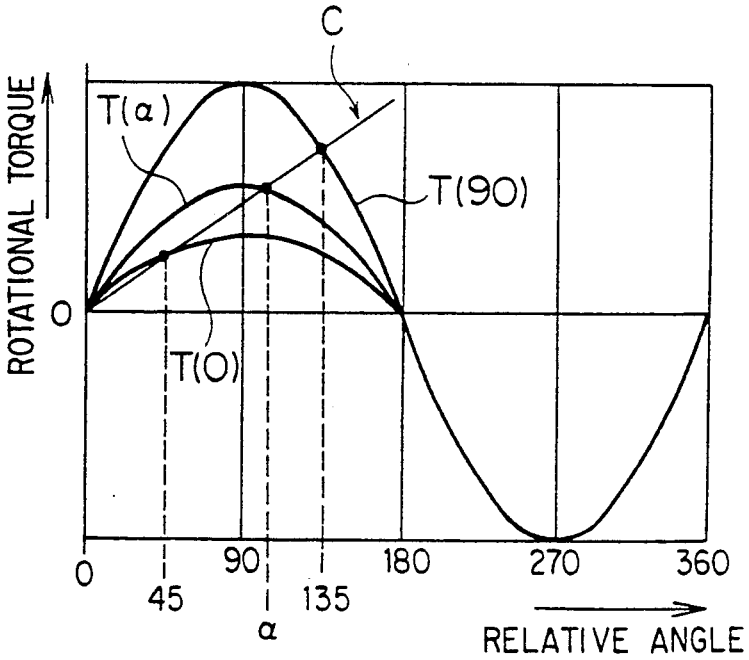
FIG. 2 is a diagram illustration the torque characteristic curves of the single-phase synchronous motor used in this invention.

FIG. 2 shows the characteristic curves of the rotational torque when d-c voltage is applied to the single-phase synchronous motor 1. The ordinate represents rotational torque and the abscissa the relative angle between the stator and the rotor. The damping torque generated by the damper spring 5 is proportional to the rotational angle of the throttle shaft 3, and is expressed by a straight line shown by arrow C in FIG. 2. Furthermore, T(0), T($\alpha$), and T(90) represents torque curves when the supply voltage to the single-phase synchronous motor 1 is V(0), V($\alpha$), and V(90) (where V(0)<V($\alpha$)<V(90). The position at which the relative angle between the stator and the rotor is 45 degree corresponds with the fully-closed position of the throttle valve 2, while the position at which the relative angle is 135 degrees corresponds with the fully-opened position.

As shown in FIG. 2, the rotational torque of the single-phase synchronous motor 1 varies with the relative angular position between the stator and the rotor, and corresponds with the magnitude of the voltage supplied. The throttle valve 2 stops at a position corresponding with the position at which the straight line C representing the damping torque generated by the damper spring 5 intersects with each of the torque curves T(0), T($\alpha$) and T(90), that is, at a rotational angular position corresponding with the position at which the damping torque generated by the damper spring 5 and the rotational torque are balanced. Consequently, the throttle valve 2 can be stopped at a fully-closed position by supplying to the single-phase synchronous motor 1 the supply voltage V(0) generating a rotational torque corresponding with torque curve T(0) intersecting the straight line C at a position at which the relative position is 45 degrees. And, the throttle valve 2 can be stopped at the fully-opened position by supplying to the single-phase synchronous motor 1 the supply voltage V(90) generating a rotational torque corresponding with the torque curve T(90) intersecting the straight line C at a position at which the relative angle is 135 degrees. The throttle valve 2 can be set at a desired angle within an approximately 90-degree range from the fully-closed position through the fully-opened position 1 by appropriately setting the supply voltage V($\alpha$) the the single-phase synchronous motor 1 within a range from V(0) through V(90).

Next, an example in which this invention is applied in the control of engine revolution will be described, referring to FIG. 3.

An electronic governor is used as a control device for controlling the opening and closing of the aforementioned throttle valve 2. The electronic governor has a comparator section 11 and a controller section 12, and controls a drive section 13 as a drive power on the basis of engine revolution and the opening degree of the throttle valve 2 as necessary. That is, the comparator section 11 in FIG. 3 compares the set signal corresponding with a desired engine revolution with an output signal of a revolution sensor 10, and outputs a signal corresponding with the difference to the controller section 12. A position sensor 14 senses the rotational angle of the single-phase synchronous motor (actuator) 1, that is the opening degree of the throttle valve 2, and outputs a signal corresponding therewith to the controller section 12. The controller section 12 controls the drive section 13 supplying d-c voltage for driving the single-phase synchronous motor 1 in accordance with the output signal of the comparator section 11 and the position sensor 14 as necessary. The single-phase synchronous motor 1 generates a rotational torque corresponding with the d-c voltage supplied from the drive section 13 to drive the throttle valve 2, as described in reference to FIG. 2. The damping force generated by the damper spring 5 varies with the rotational angle of the throttle valve 2, and the rotation of the throttle valve 2 is stopped in a state where the damping torque and the rotational torque of the single-phase synchronous motor 1 are balanced. In this way, the flow of fuel gas supplied to the engine 8, that is, the revolution of the engine 8 is controlled by controlling the rotational angle of the throttle valve 2. Since the revolution of the engine 8 is sensed by the revolution sensor 10, and a revolution signal is fed at all times to the comparator section 11 from the revolution sensor 10, the aforementioned control is effected until the revolution signal agrees with the set signal. Thus, the revolution of the engine 8 is kept at a desired set revolution.

As described above, an engine unit having a throttle-valve drive unit of a simple construction and high durability can be provided since a synchronous motor driven by d-c voltage is used as an actuator of the throttle valve.

Figure 4:
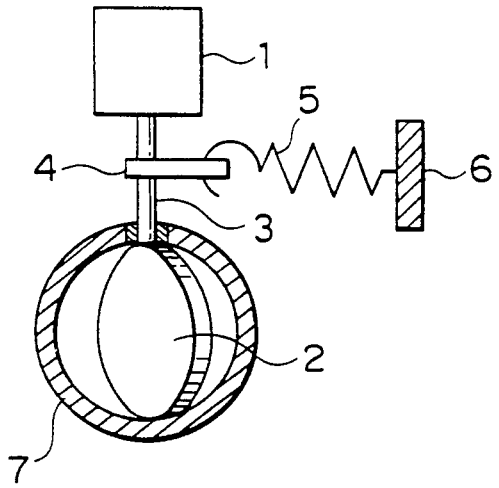
FIG. 4 is a diagram illustrating a modified form of the embodiment shown in FIG. 1.

In the aforementioned first embodiment, the relative position among the damper plate 4, the actuator 1 and the throttle shaft 3 (refer to FIG. 1) may be as shown in FIG. 4. That is, the damper plate 4 may be provided between the actuator 1 and the throttle shaft 3. Even in this case, a similar effect to the first embodiment can be accomplished.

Figure 5:
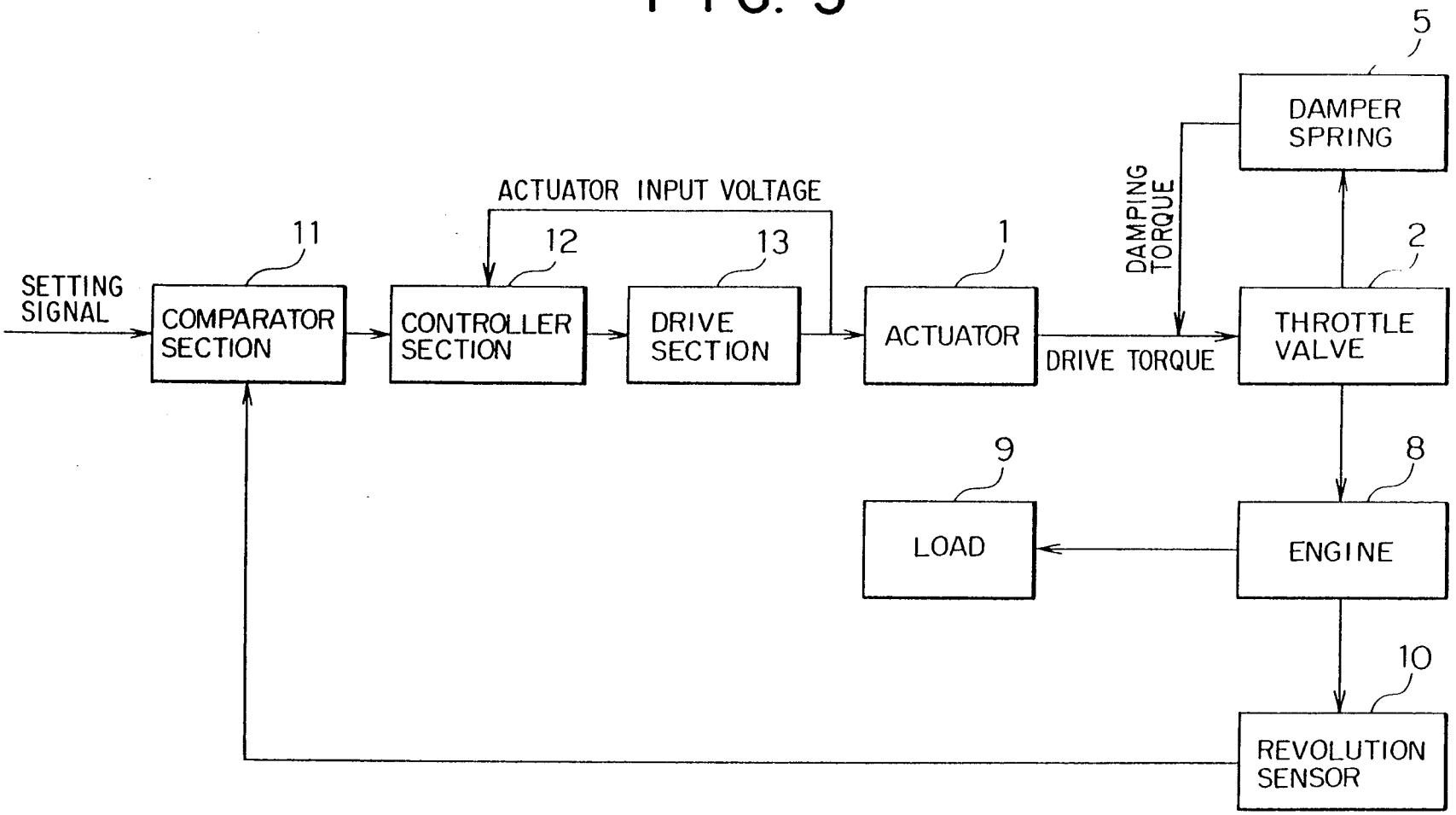
FIG. 5 is a diagram of assistance in explaining another embodiment of this invention.

FIG. 5 illustrates another embodiment of this invention. FIG. 5 is to be compared with FIG. 3.

This example is adapted so that changes in the rotational speed of the engine can be further reduced to easily change load distribution, particularly when more than two engines are operated in parallel.

When a plurality of engines are provided with more than two units thereof being operated in parallel, an engine running at higher revolution is subject to larger load. In order to keep load distribution among engines at a desired ratio, therefore, droop operation is needed. That is, the load on engines is distributed by effecting droop adjustment in which rotational speed is sloped in accordance with changes in load.

The load on the engine, which is an engine output, can be known by sensing the opening degree of the throttle valve 2. In the aforementioned embodiment, a throttle-opening-degree signal representing the opening degree of the throttle valve 2 is generated by the position sensor 14 to feed back to the controller section 12, and is adapted so that distribution of engine load can be changed to be desired ratio by effecting droop adjustment. Droop adjustment, for example, can be divided into two types; one being an isochronous operation in which the rotational speed of the engine is kept constant at all loads, and the other being an operation in which rotational speed is sloped in such a manner that rotational speed is increased at a lower load and decreased at a lower load.

Figure 6:
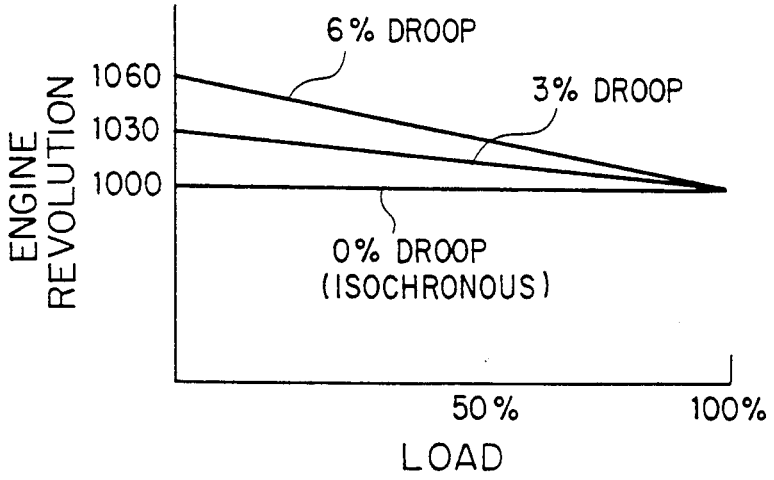
FIG. 6 is a diagram of assistance in explaining droop operation.

FIG. 6 is a diagram of assistance in explaining an example of droop adjustment. In FIG. 6, droop adjustment of 6%, 3% and 0% is shown. To change load distribution among engines, the position of the actuator 1, that is, the opening degree of throttle valve 2 is sensed, and droop is adjusted in such a manner as shown in FIG. 6 in accordance with the opening degree sensed. That is, when the units of engines are operated in parallel, for example, and the load is lopsided to any one engine, the revolution of one engine on which a higher load is imposed is decreased, while the revolution of another engine having a lower load is increased due to droop adjustment. As a result, the load on the heavily-loaded engine is decreased whereas the load on the lightly-loaded engine is increased. Thus, the parallel operation of two engines can be maintained without causing the load to be lopsided to any one engine. The potentiometer used as the position sensor 14 for sensing the opening degree of the throttle valve 2 involves mechanical contact, is susceptible to vibration, and may sometimes inferior in durability. The encoder as the position sensor 14 is accurate in position sensing, but it is too expensive as an electronic governor for engine.

In this embodiment, therefore, an electronic governor for engines is used in which the input voltage of the actuator is fed back to the controller section so as to allow load distribution among engines can be freely changed. That is, a feed-back means for feeding the d-c voltage fed to the actuator 1 back to the controller section 12 is provided in place of the position sensor 14 (see FIG. 3) in the aforementioned embodiment so that load distribution among engines can be set by imparting to the output of the controller section a characteristic that decreases in accordance with increases in load based on the amount of feedback of the feedback means.

More specifically, the input voltage of the actuator 1 is fed back to the controller section 12 in place of the output of the position sensor 14.

Engine revolution is sensed by the revolution sensor 10 to compare the sensed engine revolution with the set signal in the comparator section 11. An output corresponding with the amount of error caused as the result of comparison in the comparator section 11 is outputted from the controller section 12. The output causes the drive section 13 to produce a torque to drive the actuator 1. The throttle valve 2 is displaced as the actuator is driven to maintain an equilibrium with the damper spring 5. Since a predetermined relationship is maintained between the opening degree (displacement angle) of the throttle valve 2 and the magnitude of the input voltage of the actuator 1 in this equilibrium state, the opening degree of the throttle valve 2 can be known by measuring the magnitude of the input voltage of the actuator 1. Consequently, load distribution among engines can be set to a desired ratio by effecting droop adjustment on the basis of the input voltage of the actuator 1 and feeding back the droop adjustment to the controller section 12 so that the droop adjustment has a desired slope characteristic as shown in FIG. 6.

That is, the controller section 12 modulates the output level of the controller section 12 on the basis of the input voltage of the actuator 1 so that a desired droop can be given to change the revolution of the engine in accordance with changes in the load, as shown in FIG. 6. Thus, desired load distribution can be accomplished among a plurality of engines.

According to this invention, the opening degree of the throttle valve 2, which is adjusted by the balance maintained between the drive force of the actuator 1 and the damper spring 5, is proportional only to drive force of the actuator 1. This allows the position of the throttle valve 2 to be sensed electronically, not mechanically, resulting in a highly durable, accurate and inexpensive electronic governor for engines.

The electronic governor for engines of this invention can freely change load distribution among engines.

The embodiment shown in FIG. 5 can be applied to other constructions than that using a single-phase synchronous motor as the actuator 1. That is, the embodiment shown in FIG. 5 can be applied to a wide range of applications where a predetermined relationship holds between the input voltage of the actuator 1 and the opening degree of the throttle valve 2.

Figure 7:
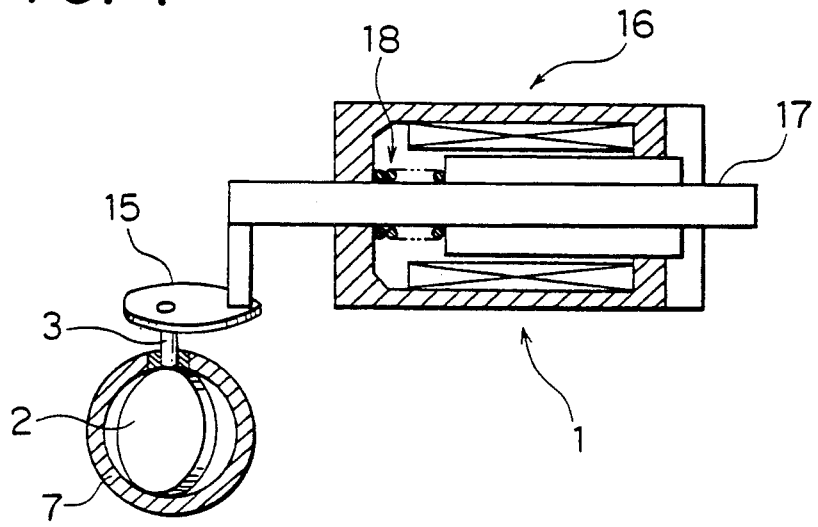
FIG. 7 is a diagram illustrating an application of the embodiment shown in FIG. 5.

The embodiment can be applied to such a construction that a solenoid 16 is used as the actuator 1, as shown in FIG. 7. In this case, the throttle shaft 13 of the throttle valve 2 is driven by the actuator 1 via the linkage mechanism 15. The movable armature 17 of the solenoid 16 in the actuator 1 is driven toward the left side of FIG. 7 in proportion to the input voltage of the actuator 1. The movable armature 17 moves resisting the damper spring 18, but stops in an equilibrium state. The input voltage of the actuator 1 to drive the movable armature 17 of the solenoid 16 and the opening degree of the throttle valve 2 at this time is in the predetermined relationship. That is, the relationship between the rotational torque given by the input voltage and the opening degree of the throttle valve 2, through varies in detail, is generally close to that shown in FIG. 2. Consequently, the opening degree of the throttle valve 2 can be regulated by electronically sensing and feeding back to the controller section the input voltage of the actuator 1, as shown in FIG. 5.

Figure 8:
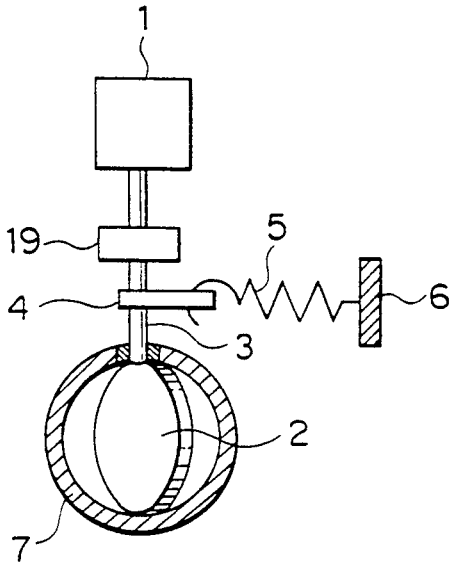
FIG. 8 is a diagram of assistance in explaining an example in which the actuator and the throttle shaft are connected with a coupling.
Figure 9:
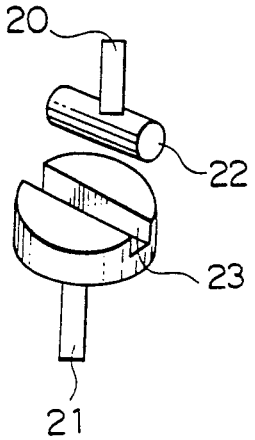
FIG. 9 is a diagram of assistance in explaning the coupling.

FIGS. 8 and 9 show still another embodiment of this invention. FIG. 8 is to be compared with FIGS. 1 or 4.

This embodiment has a construction that can be more easily manufactured than the first embodiment, and is adapted to disregard the resulting backlash with a simple means.

In the aforementioned first embodiment, the throttle shaft 3 is connected directly to the actuator 1 since the drive torque of the actuator 1 often does not agree with the opening degree of the throttle valve 2 if there is a backlash between the throttle shaft 3 and the actuator 1. To connect the throttle shaft 3 directly to the actuator 1, however, involves considerable labor in aligning both. Connecting the throttle shaft 3 to the actuator 1 via a coupling would require an expensive high-precision coupling to eliminate the backlash of the coupling.

In this embodiment, therefore, a coupling 19 is provided between the throttle shaft 3 and the actuator 1 to connect both, with the damper spring 5 disposed on the side of the throttle shaft 3, and the coupling 19 connecting the actuator 1 and the throttle shaft 3 disposed between the damper spring 5 and the actuator 1.

More specifically, the shaft of the actuator 1 is connected to the throttle shaft 3 via the coupling 19, as shown in FIG. 8. The damper spring 5 is connected between the throttle shaft 3 and the coupling 19. The coupling 19 may be of such a construction that an upper coupling 20 has a projection 22 that fits into a slot 23 provided on a lower coupling 21. The coupling of this type having a simple construction inevitably involves backlash. With this arrangement, however, rotational torque agrees with the opening degree of the throttle valve 2 due to the damping torque of the damper spring 5, which is connected to the side of the throttle shaft 3, rather than to the side of the coupling 19. Thus, backlash can be ignored and the relationship between the rotational torque shown in FIG. 2 and the opening degree of the throttle valve 2 can be maintained.

As described above, this arrangement eliminates the need for aligning the throttle shaft 3 and the shaft or the actuator 1. The coupling 19 used in this embodiment is of a simple and inexpensive construction. Backlash can be absorbed by using the damper spring 5 that is originally used for generating the damping torque to resist rotational torque. The existence of backlash allows misalignment of the throttle shaft 3 and the shaft of the actuator 1 to be absorbed. This advantage makes manufacture easy.

Figure 3:
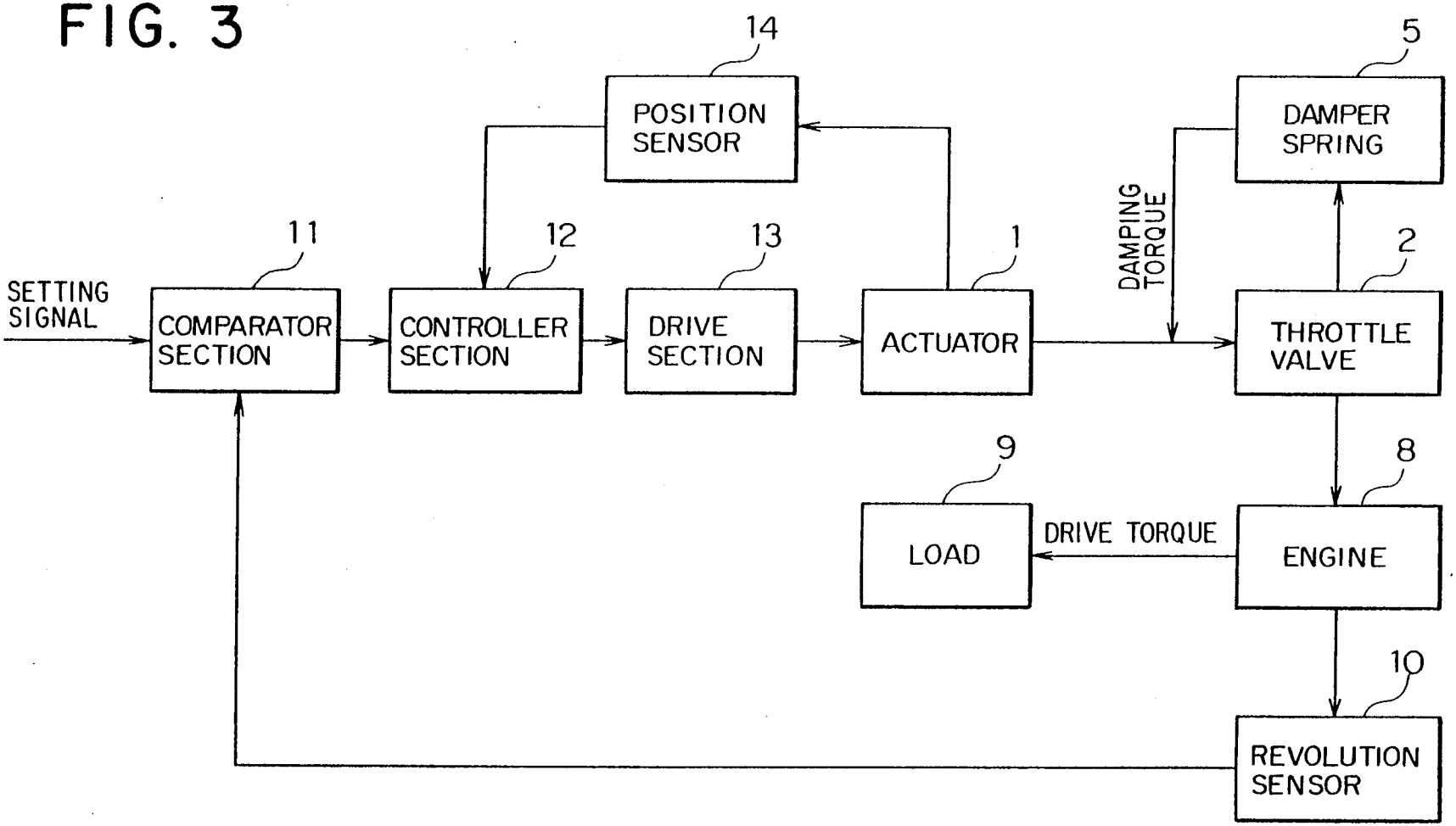
FIG. 3 is a block diagram of an embodiment of this invention.

In this embodiment, it is preferable to use a means shown in FIG. 5, rather than an means shown in FIG. 3, to sense the opening degree of the throttle valve 2. Since the damper spring 5 absorbs backlash, the input voltage of the actuator 1 can be fed back as a value indicating the opening degree of the throttle valve 2. By using such an electronic means, an even more inexpensive and simpler construction could result.

Figure 10:
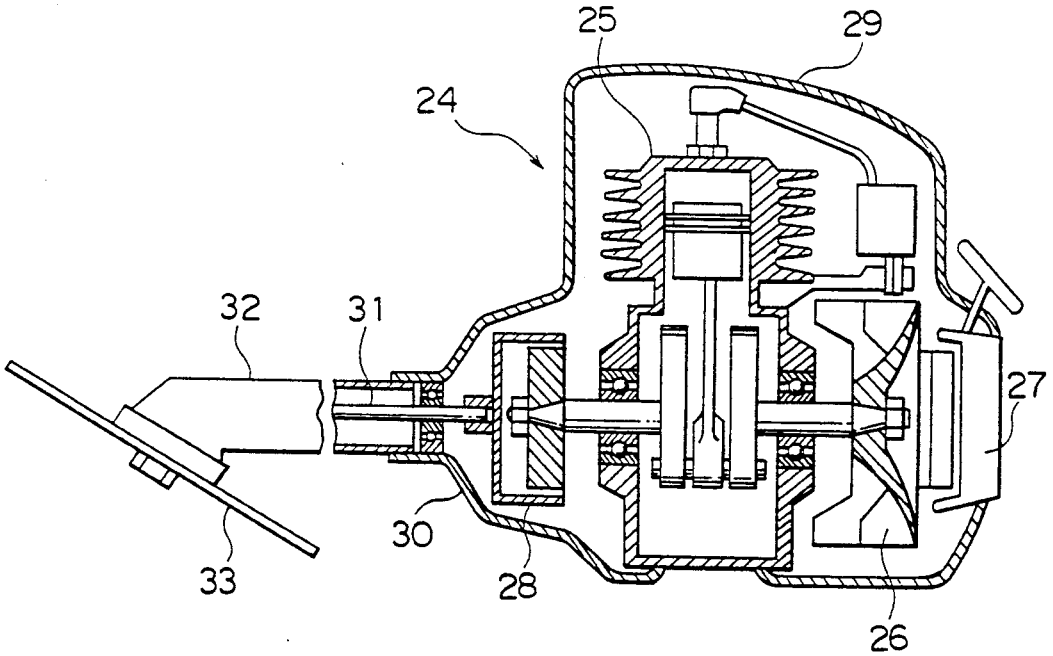
FIG. 10 is a longitudinal sectional diagram illustrating the essential part of an engine unit for the power mower.

FIG. 10 is a longitudinal sectional view of the essential part of an engine unit embodying this invention, particularly an engine unit typically used for power mowers. In FIG. 10, an engine unit 24 consists of major components, including an internal combustion engine 25, a flywheel 26, a starter 27, and a centrifugal clutch 28, and the entire assembly thereof is enclosed with a cover 29. A mower shaft 32 having a rotary shaft 31 is fixedly fitted to a frame on the output-shaft side. Numeral 33 refers to a cutter connected to the rotary shaft 31 in such a manner as to move together with the rotary shaft 31.

With this arrangement, when the internal combustion engine 25 is started by the starter 27, the power of the internal combustion engine is transmitted to the rotary shaft 31 in the mower shaft 32 via the centrifugal clutch 28 to cause the cutter 33 to rotate.

In this engine unit 24, the throttle valve 2 is opened and closed by the aforementioned means to keep the number of revolution of the engine, that is, the cutter 33 constant in accordance with the magnitude of load.

As the revolution of the output shaft of the internal combustion engine 25, that is, the revolution of the driving shaft of the centrifugal clutch 28 falls below a predetermined value, transmission of rotational force to the driven shaft is discontinued, causing the cutter 33 to stop rotation.

In the meantime, a drive power source is needed as the drive section 13 to drive the actuator 1. A battery is most commonly used as a drive power source. That is, a battery is installed on the engine unit 24. The use of a battery as the drive power source, however, could increase the weight of the entire engine unit 24. In a portable engine unit, aside from a stationary unit, this would result in troublesome handling and transportation, leading to lowered working efficiency. In this respect, an engine unit 24 incorporating a generator is preferred. This type of engine unit, however, requires space for housing a generator. In a portable engine unit of the conventional type which has a construction to reduce internal space wherever practicable to reduce the weight of the unit, it is impossible to incorporate a generator in the limited space with ordinary means. When incorporating a generator, the construction or shape of the engine unit will have to be substantially changed. On the other hand, there is a type of engine unit which does not necessarily require a generator. Consequently, there is a need to manufacture both types with a common construction wherever practicable. It is desirable in terms of manufacture to be an engine unit 24 of a type that can easily accommodate a generator without major modifications.

This embodiment employs a means in which a cylindrical generator is fixedly fitted to a frame 30 on the output shaft side of the engine unit 24 incorporating an internal combustion engine 25, and an end of a rotor shaft as a component of the generator is connected to the outout shaft of the engine unit 24 concentrically and in an axially unrestricted state, with the other end of the rotor shaft used as a new output shaft, or a means in which a yoke having a field is integrally fitted to a rotary member on the driving side of a clutch 28 provided on the output shaft of the engine unit 24 incorporating the internal combustion engine 25, and a coil member is provided on a frame 30 of the engine unit 24 within a magnetic range of the field of the yoke to integrate the generator with the clutch.

Figure 11A:
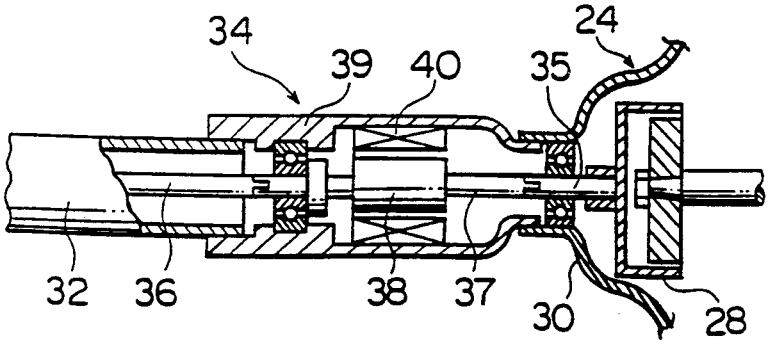
FIG. 11A is a longitudinal sectional diagram illustrating the essential part of a dynamo of this invention.

FIG. 11A is a longitudinal section of the essential part of a generator according to this invention. In FIG. 11A, numeral 34 denotes a generator that is formed into a cylindrical shape. The generator 34 is fixedly fitted to a frame 30 on the output shaft side of the engine unit 24. A male thread is provided on an end of the generator 34 on the side of the frame 30, whereas female thread is provided on an end of the frame 30 on the side of the generator 34. The generator 34 is fixedly fitted to the frame 30 by screwing the male thread into the female thread. The generator 34, on the other hand, is fixedly fitted to a mower shaft 32. A female thread is provided on an end of the generator 34 on the side of the mower shaft 32, whereas a male thread is provided on an end of the mower shaft 32 on the side of the generator 34. By screwing the male thread into the female thread, the generator 34 is fixedly fitted to the mower shaft 32.

The screwing direction of these male and female threads should preferably be the same as the rotating direction of a rotary shaft 36. Numeral 37 denotes a rotor shaft, to which a rotor 38 consisting of a permanent magnet, for example, is integrally fitted so that the rotary shaft 37 and the rotor 38 can be rotated while facing a stator winding 40 provided on the inner circumferential surface of a cylindrical body 39.

Figure 11B:
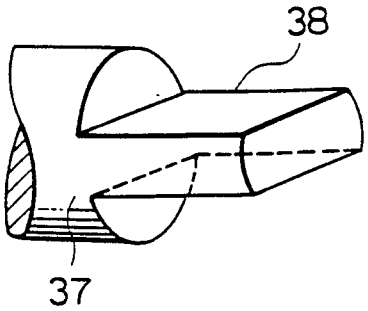
FIGS. 11B and 11C are enlarged perspective views illustrating the shape of both ends of the rotor shaft shown in FIG. 11A.
Figure 11C:
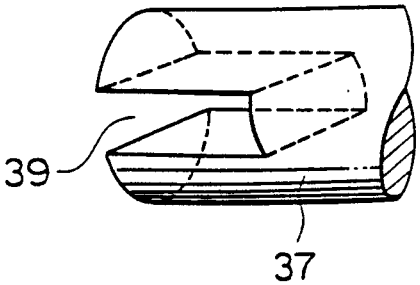

FIGS. 11B and 11C are enlarged perspective views illustrating the shape of both ends of the rotor shaft 37 shown in FIG. 11A. In both figures, numeral 38 refers to a projection; 39 to a slot. The projection 38 and the slot 39 are formed in such a fashion as to engage with the slot provided on the output shaft 35 shown in FIG. 11A and the projection provided on the rotary shaft 36 in an axially unrestricted state. The projection provided on the rotary shaft 36 shown in FIG. 11A is formed in such a fashion as to engage with the slot porived on the output shaft 35 in an axially unrestricted state.

With the abovementioned construction, when the generator 34 is screwed onto the frame 30 on the side of the output shaft 35 of the engine unit 24, as shown in FIG. 11A, an end of the rotor shaft 37 is integrally and rotatably connected to the output shaft 35. With this arrangement, the other end of the rotor shaft 35 can be used as a new output shaft.

Thus, by screwing the mower shaft 32 onto the generator 34, the rotary shaft 36 is integrally and rotatably connected to the rotor shaft 35. This allows the rotary shaft 36 to be rotated by the engine unit 24. The power generated by the rotation of the rotor shaft 37 is supplied to the electronic governor and other electric equipment via output terminals (not shown). That is, the generator 34 can be used as a drive power source for the drive section 13. Furthermore, the generator 34 can also be used as a power source for engine spark plugs.

In an engine unit that does not require a generator 34, the mower shaft 32 is fixedly fitted directly to the frame 30. That is, the male thread of the mower shaft 32 is screwed into the female thread. This allows the slot (corresponding with the projection 38) of the output shaft 35 to be integrally and rotatably connected to the projection (corresponding with the slot 39) of the rotary shaft 36. Thus, the output shaft 35 can be connected directly to the rotary shaft 36.

Figure 12:
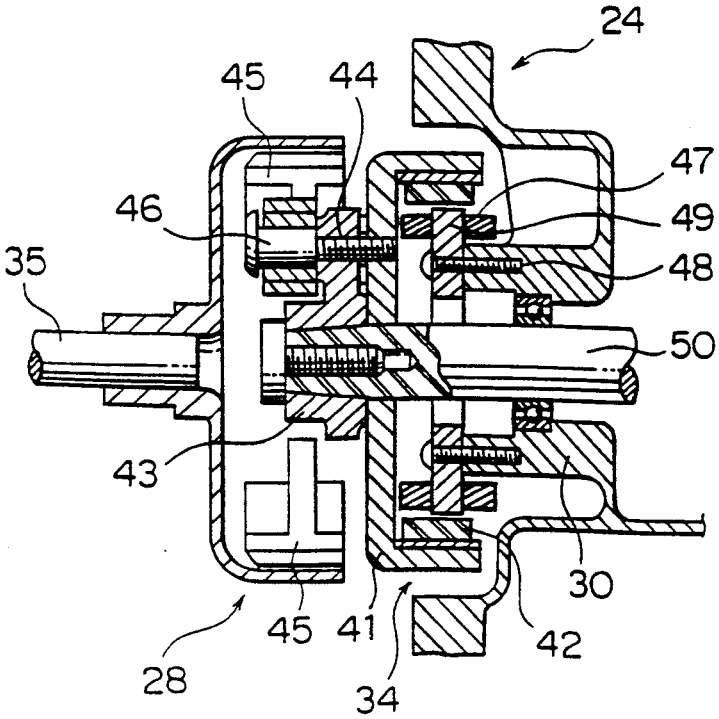
FIG. 12 is an enlarged longitudinal sectional view of the essential part of another example of a dynamo of this invention.

FIG. 12 is an enlarged longitudinal section of the essential part of another construction of the generator 34. A yoke 41 is made of a ferromagnetic material, such as mild steel, and formed into a cup shape, on the inner circumferential surface of which a field consisting of a permanent magnet is fitted, and fixedly and integrally fitted via a retaining screw 44 to a clutch box 43 comprising a centrifual clutch 28. The retaining screw 44 is desirable to be formed integrally with the rotary shaft 46 of a clutch shoe 45. A coil 47 is fitted to the outer circumferential surface of a coil member 49 fixedly fitted via a retaining screw 48 to a frame 30 comprising an engine unit 1, and disposed within a magnetic range of the field 42 provided on the yoke 41.

With the above construction, the generator 34 is formed with the field 42 and the coil 47. That is, power can be induced in the coil 47 by rotating the output shaft 50 to supply to the electronic governor and other electrical equipment, as in the case of the aforementioned generator 34. With the construction shown in FIG. 12, power supply can be immediately started since the field 42 begins rotating simultaneously with the operation of the internal combustion engine that triggers the rotation of the output shaft 50.

The aforementioned embodiments have been described in reference to the engine units applied to mowers, but the engine unit of this invention can be applied to those used for blowers, chemical sprayers as well. Although the embodiments have been described referring to a centrifugal clutch as the clutch installed in the neighborhood of the output shaft, other types of clutches may be used. Furthermore, as a means for connecting the engine unit to a mower shaft or other operating equipment, other known fitting means than screwing means can be used.

With the aformentioned construction, an engine unit 24 having a generator can be manufactured without major modifications in the components of the engine unit 24. Furthermore, the engine unit 24 with or without a generator can be assembled on the same assembly line since major components of the engine unit 24 of this invention are common to those used in the conventional engine 24, as described above. The use of a generator having an extremely simple construction can eliminate special space for incorporating the generator in the engine unit, making the entire unit compact. Moreover, the fact that the engine unit 24 with or without a generator can be manufactured in the same process and on the same assembly line permits the use of common components, leading to improved production control and work control.

What is claimed is:

1. An engine unit having a throttle value drive unit adapted to cause a throttle valve to rotate and stop at a desired angular position, the engine unit comprising, an actuator for driving said throttle valve, a damping means for suppressing the rotation of said throttle valve, a power supply means for supplying d-c voltage to said actuator, and a supply voltage control means for controlling the d-c voltage outputted by said voltage supply means; said throttle valve being adapted to stop at an angular position at which the rotational torque generated by said actuator in accordance with the supply voltage of said supply voltage control means and the damping torque of said damping means are balanced.

2. An engine unit as set forth in claim 1 wherein said actuator is a synchronous motor.

3. An engine unit as set forth in claim 1 wherein said damping means is damper spring.

4. An engine unit as set forth in any one of claims 1 through 3 wherein said actuator is connected directly to a throttle shaft of said throttle valve.

5. An engine unit as set forth in any one of claims 1 through 3 wherein said actuator is connected to a throttle shaft of said throttle valve via a coupling.

6. An engine unit as set forth in claim 5 wherein said coupling consists of an upper coupling on which a projection is formed, and a lower coupling on which a slot is formed.

7. An engine unit as set forth in claim 5 wherein said dampling means is provided on the side of said throttle valve with respect to said coupling, and therefore said coupling is provided between said actuator and said damping means.

8. An engine unit comprising:

an actuator for driving a throttle valve, a damping means for suppressing the rotation of said throttle valve, a voltage supply means for supplying d-c voltage to said actuator, a supply voltage control means for controlling the d-c voltage outputted by said voltage supply means, and a feedback means for feeding back the d-c voltage supplied to said actuator to said supply voltage control means; said throttle valve being adapted to stop at a position at which the rotational torque generated by said actuator in accordance with the supply voltage of said voltage supply means and the damping torque of said damping means resisting said rotational torque are balanced, and the output of said voltage supply means being caused to change in accordance with changes in load by the amount of feedback of said feedback means.

9. An engine unit as set forth in claim 8 wherein a plurality of engines are provided, a throttle valve is caused to rotate in accordance with each of said engines and to stop at a desired angular position, and load distribution among said engines in accordance with the amount of said feedback.

10. An engine unit incorporating an internal combustion engine and a generator in which said generator formed in a cylindrical shape is fixedly fitted to a frame on the side of an output shaft of said engine unit; said generator having such a construction that an end of a rotor shaft comprising said generator is connected to said engine unit output shaft concentrically and in an axially unrestricted state; the other end of said rotor shaft used as a new output shaft.

11. An engine unit as set forth in claim 10 wherein either of male of female thread is provided on an end of said generator on the side of said frame, and the other of said male or female thread is provided on an end of said frame on the side of said frame to fixedly fitting said generator to said frame.

12. An engine unit as set forth in claim 10 wherein either of a projection or slot is provided on an end of said rotor shaft, and the other of said projection or slot is provided on the other end of said rotor shaft; whereas either of a projection or slot is provided on an end of said engine unit output shaft to correspond with an end of said rotor shaft, and the other of said projection or slot is provided on an end of a rotary shaft newly connected to said rotor shaft to correspond with the other end of said rotor shaft.

13. An engine unit incorporating an internal combustion engine and a generator in which said generator has such a construction that a yoke having a field is integrally and fixedly fitted to a rotary member on the driving side of a clutch provided on said engine output shaft, and a coil member is provided on a frame of said engine unit within a magnetic range of said field providing on said yoke, thereby integrating said generator with said clutch.

* * * * *